US005959581A

United States Patent [19]

Fusinski

[11] Patent Number: 5,959,581

[45] Date of Patent: Sep. 28, 1999

[54] VEHICLE ANTENNA SYSTEM

[75] Inventor: Richard E Fusinski, Clinton Township, Macomb County, Mich.

[73] Assignee: General Motors Corporation, Detroit, Mich.

[21] Appl. No.: 08/920,247

[22] Filed: Aug. 28, 1997

[51] Int. Cl.[6] ..... H01Q 1/38; H01Q 1/32

[52] U.S. Cl. ..... 343/700 MS; 343/713; 343/712; 343/711

[58] Field of Search ..... 343/712, 713, 343/711, 700 MS

[56] References Cited

U.S. PATENT DOCUMENTS

| | | | |
|---|---|---|---|
| H1230 | 9/1993 | Stern et al. | 343/700 |
| 4,707,700 | 11/1987 | Nagy | 343/712 |
| 4,721,963 | 1/1988 | Nagy et al. | 343/712 |
| 4,723,127 | 2/1988 | Ohe et al. | 343/712 |
| 4,737,795 | 4/1988 | Nagy et al. | 343/712 |
| 4,769,655 | 9/1988 | Nagy et al. | 343/712 |
| 4,821,040 | 4/1989 | Johnson et al. | 343/700 |
| 4,835,541 | 5/1989 | Johnson et al. | 343/713 |
| 4,845,505 | 7/1989 | Ohe et al. | 343/712 |
| 4,887,089 | 12/1989 | Shibata et al. | 343/700 |
| 5,083,135 | 1/1992 | Nagy et al. | 343/713 |
| 5,095,314 | 3/1992 | Shinnai et al. | 343/713 |
| 5,128,685 | 7/1992 | Shinnai et al. | 343/713 |
| 5,231,408 | 7/1993 | Nakase | 343/704 |
| 5,239,302 | 8/1993 | Maeda et al. | 343/704 |
| 5,266,960 | 11/1993 | Lindenmeier et al. | 343/704 |
| 5,355,144 | 10/1994 | Walton et al. | 343/713 |
| 5,402,134 | 3/1995 | Miller et al. | 343/742 |
| 5,418,543 | 5/1995 | Bolton | 343/713 |
| 5,512,910 | 4/1996 | Murakami et al. | 343/700 MS |
| 5,517,206 | 5/1996 | Boone et al. | 343/806 |
| 5,568,156 | 10/1996 | Terashima et al. | 343/713 |

*Primary Examiner*—Don Wong
*Assistant Examiner*—James Clinger
*Attorney, Agent, or Firm*—Jeffrey A. Sedlar; Vincent A. Cichosz

[57] ABSTRACT

A high-frequency vehicle patch antenna such as for GPS or cellular communication systems is mounted close to the conductive roof panel on an interior surface of the vehicle windshield or backglass. Low impedance coupling to the roof panel is employed to alter the focus and gain characteristics of the antenna such that maximum antenna gain is more closely aligned to zenith, and gain improvements in the general direction over the roof panel and improved omnidirectionality result.

10 Claims, 3 Drawing Sheets

VEHICLE ANTENNA SYSTEM

TECHNICAL FIELD

The present invention is related to patch antennas.

BACKGROUND OF THE INVENTION

The Global Positioning System, or GPS, includes a plurality of non-geosynchronous earth-orbiting satellites which transmit signals in the microwave frequency band for reception by earth-based land, sea or air antennas. The various received satellite signals are processed to discern the position of the receiving antenna, generally associated with a vehicle, for general navigational use.

Consistent with the generally accepted objective of providing omni-directional reception capability of the vehicle receiving the GPS signals, the desired maximum gain of the antenna system is substantially zenithal. Such arrangement provides for substantially azimuthally symmetrical reception advantageously allowing for receiving signals from widely separated satellites which signals provide optimal positional resolution.

A preferred antenna for such applications is known as a patch antenna and essentially includes a tuned resonant structure comprising a dual-faced planar ceramic substrate with a thin metallic patch disposed on one face and a grounding conductor disposed on the opposite face. The patch antenna is conventionally utilized in conjunction with an extended ground plane structure which is coupled to the grounding conductor and effective to reduce detrimental external influences on the antenna and maintain the radiation pattern substantially normal to the substrate regardless of surrounding structures. Known varieties of such extended ground planes include package integrated extended ground planes which increase package size of the antenna assembly and external extended ground planes such as the exterior surface of a substantially horizontal vehicle panel. As can be appreciated from the description, an external extended ground plane antenna assembly requires exposed exterior placement on a vehicle which, among other concerns, is aesthetically unacceptable for passenger car applications. A package integrated extended ground plane antenna assembly, while operative autonomously with respect to exterior vehicle panels and substantially unaffected by proximal placement with respect thereto, still suffers from certain trade-offs in the application to passenger car vehicles. For example, optimal azimuthally symmetrical performance dictates that unobstructed roof-top placement be employed. This option, as mentioned, is aesthetically and otherwise unacceptable in passenger car applications. Placement immediately adjacent the interior surface of the windshield or backlight glass also has been proposed but fails acceptance for reasons of (a) visual obstruction from relatively large packaging footprint and (b) substantial signal attenuation in the direction over the vehicle roof panel due to the maximum gain focus being oppositely oriented in accordance with the rake of the glass and direct obstruction of the signal by the roof panel at acute reception angles relative to the horizon. Integration of a package integrated extended ground plane antenna assembly beneath the rear package shelf and vertically below the vehicle backglass has also been explored but also suffers from direct obstruction of the signal by the roof panel.

Patch antennas without extended ground planes have been proposed for glass mount automotive application. Such antennas, however, are generally detrimentally sensitive to proximal placement to the vehicle sheet metal. Hence, proper operation is limited to substantially central placement on the windshield or backglass which is unacceptably within the field of vision of the vehicle operator. Movement closer to the roof panel, hood, or deck lid significantly and detrimentally detunes the antenna from the desired center frequency, changes the gain characteristics and shifts the radiation pattern. Additionally, as previously demonstrated with respect to glass mounted arrangements, substantial signal attenuation in the direction over the vehicle roof panel and direct obstruction of the signal by the roof panel at acute reception angles relative to the horizon remain shortfalls.

SUMMARY OF THE INVENTION

In a motor vehicle having an electrically conductive roof panel and a glass panel such as a windshield or backlight, a patch antenna provides for substantially omni-directional reception without cumbersome packaging constraints resulting from extended ground planes. A patch antenna is secured to an interior surface of the glass panel adjacent the roof panel of the vehicle. The patch antenna includes a grounding conductor on the back side of the antenna's high dielectric substrate. A low impedance coupling between the grounding conductor and the roof panel is provided. The focus of the antenna is altered and antenna gain is increased in the general direction over the roof panel resulting in improved antenna reception performance.

In accordance with one aspect of the invention, the low impedance coupling is provided by a thin strip of conductive material. The conductive strip is coupled—such as by soldering—to the grounding conductor and through a low impedance capacitive coupling to the roof panel. The capacitive coupling with the roof panel may be provided by a portion of the strip having substantial surface area secured to the underside of the roof panel by adhesive.

Minimization of undesirable tuning effects may be accomplished by controlling the dimensions of the portion of the conductive strip between the coupling to the grounding conductor and the first point of capacitive coupling to the roof panel. Preferably, the length of this portion of the conductive strip does not exceed approximately one-eighth of the wavelength of the desired frequency signal to be detected. Further, the width of this portion of the conductive strip is no less than one-eighth of the wavelength of the desired frequency signal to be detected.

BRIEF DESCRIPTION OF THE DRAWINGS

The present invention will now be described by way of example with reference to the accompanying drawings in which.

DESCRIPTION OF THE PREFERRED EMBODIMENT

Figure 2:
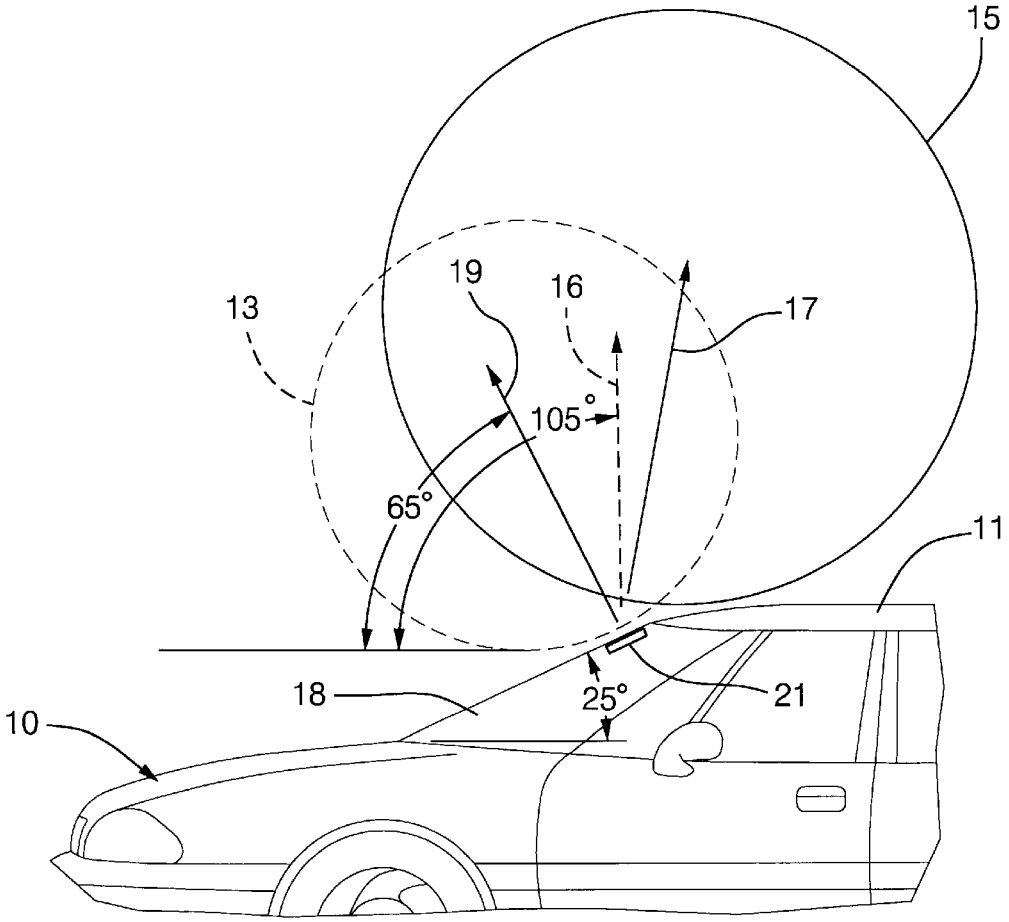
FIG. 2 shows a side view of a typical vehicle, preferred antenna installation location, and antenna focus characteristics illustrative of the performance advantage of the present invention.

With reference first to FIG. 2, a vehicle shown in side view is labeled with the reference numeral 10 and includes a windshield 18 having an exemplary rake angle of substantially 25 degrees relative to horizontal. Generally, passenger automobile windshield rake angles are between 20 and 45 degrees though the specific rake angle poses no limitation to the applicability of the present invention. The vehicle 10 also includes a roof panel 11, the frontal portion of which is immediately adjacent the windshield 18. A patch antenna in accordance with the present invention is generally labeled 21 and is mounted to the inner surface of the windshield in spaced adjacency to the edge of the roofline.

The vector with broken lead line labeled 16 in FIG. 2 corresponds to the generally accepted preferred maximum gain direction, also referred to as antenna focus, which is substantially zenithal with respect to the patch antenna. The vector with solid lead line labeled 19 is substantially normal to the plane of the patch antenna 21 which has a 25 degree attitude in substantial conformance to that of the windshield glass surface to which it is secured. The vector with solid lead line labeled 19 represents the antenna focus absent any effects of the proximal roofline and the present invention. The broken circle labeled 13 in the figure is a relative two-dimensional representation of the radiation pattern of the patch antenna 21 absent any effects of the proximal roofline and the present invention. The vector with solid lead line labeled 17 represents the antenna focus in accordance with the present invention. The larger circle labeled 15 in the figure is a relative two-dimensional representation of the radiation pattern of the patch antennas 21 in accordance with the present invention.

Figure 1:
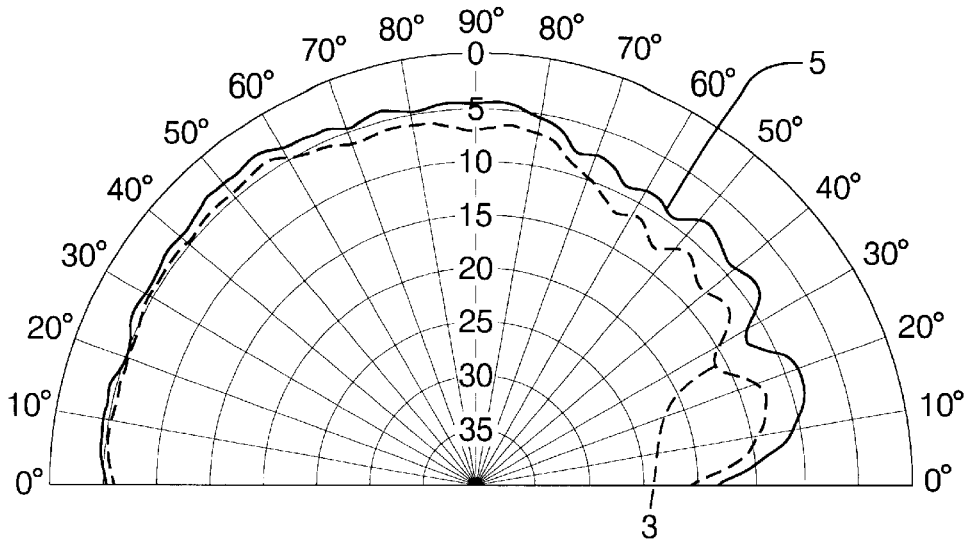
FIG. 1 shows comparative polar plots of antenna gains from front to back over a vehicle illustrative of the performance advantage of the present invention.

With reference additionally to FIG. 1, a comparative plot of antenna gain vs. two-dimensional reception angle swept across the top of the vehicle in the plane normal to the earth and from back to front of the vehicle illustrates the general improvement in performance of the patch antenna in accordance with the present invention over a similarly placed patch antenna void of the present invention. The origin of the plot is substantially the center point of the vehicle roof 11 and hence is offset from the location of the patch antenna as illustrated in FIG. 2. The angular divisions correspond to the angular direction of measurement while the radial divisions correspond to the antenna gain in 5 dB increments. Empirically collected performance data for a patch antenna being mounted as generally described with and without the benefit of the present invention supports the focal shift of the antenna from substantially along the vector labeled 19 at 65 degrees from horizontal to substantially along the vector labeled 17 at 105 degrees from horizontal or substantially 15 degrees rearward of the optimal zenithal vector labeled 16 as schematically depicted in FIG. 2. Data plotted as the broken line trace labeled 3 corresponds to a patch antenna without the features of the present invention and the data plotted as the solid line labeled 5 in the figure corresponds to a patch antenna with the features of the present invention. As graphically depicted in the plot of FIG. 1, it can be seen that from 0 degrees to approximately 60 degrees relative to the frontal horizon of the vehicle the difference in antenna gain is generally less than 2 dB in favor of the patch antenna employing the present invention. The advantageous gain and focusing benefits of the present invention are more prevalent as the reception angle increases beyond approximately 60 degrees and are most acute on the back side of the zenithal vector toward the rear of the vehicle where the gain is typically improved by 5 dB or almost fourfold. With each dB of improved gain, the reception signal to noise ratio improves by a factor of substantially 1.4 or by about a factor of 7 with a 5 dB gain improvement.

Figure 3:
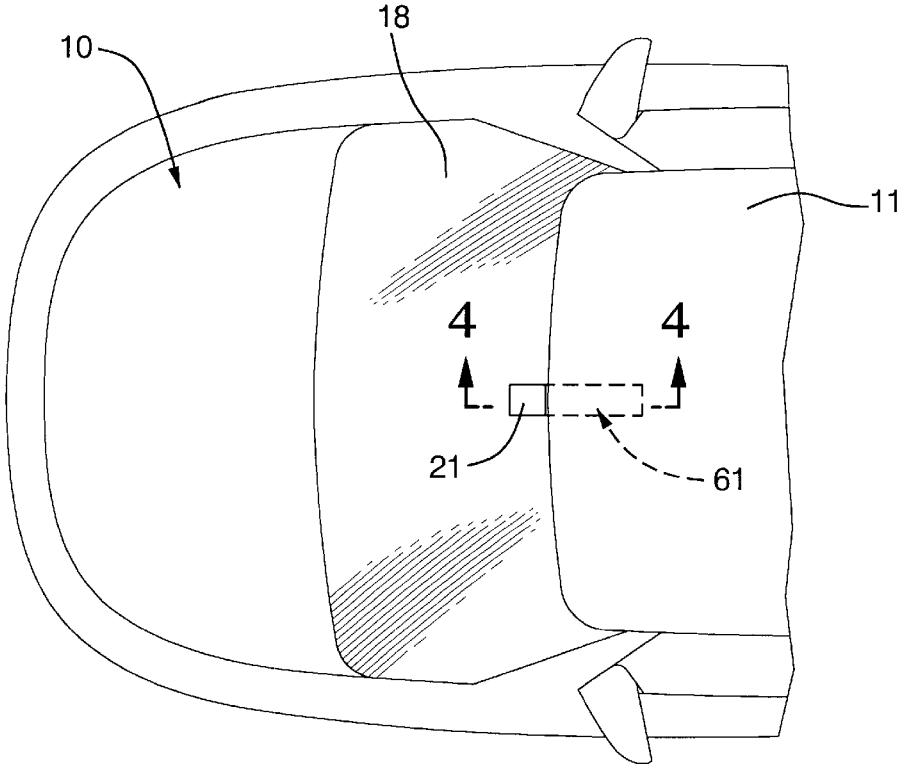
FIG. 3 is an overhead view of a typical vehicle showing a preferred antenna installation location in accordance with the present invention.

In accordance with the present invention, an overhead view of a vehicle 10 is illustrated in FIG. 3 showing a preferred arrangement of an antenna in accordance with the present invention. Patch antenna 21 is shown installed to the inner surface of vehicle windshield 18 substantially adjacent the roof panel 11. A grounding strip 61 is shown extending generally from the patch antenna 21 rearward in the vehicle beneath the roof panel. Alternatively, the patch antenna 21 and grounding strip 61 may be secured to the vehicle backlight glass in the same relative substantially adjacent orientation with the roof panel.

Figure 4:
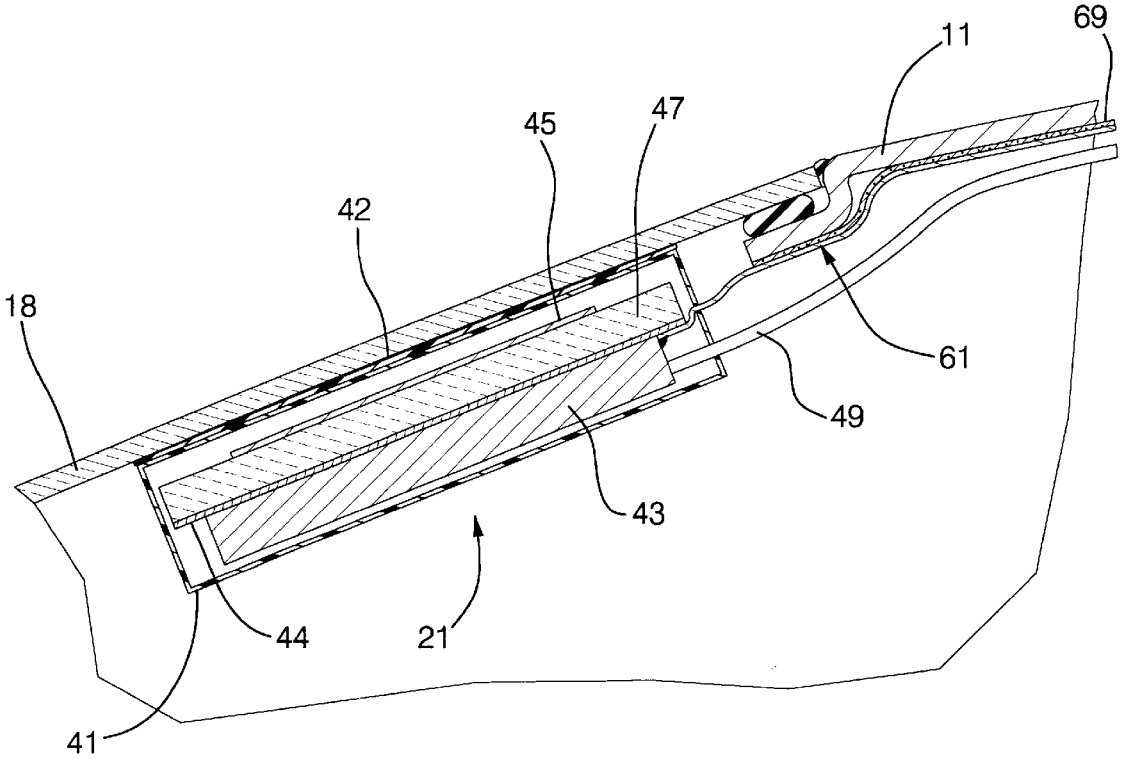
FIG. 4 shows a sectional view of an antenna and portion of a vehicle taken along line 4—4 of FIG. 3; and, FIG. 5 illustrated certain preferred relationships among an antenna and vehicle in accordance with the present invention.

With reference to FIG. 4, a sectional view through the patch antenna 21 and surrounding portions of the vehicle taken along the section line labeled 4—4 in FIG. 3 is described. Various features of the patch antenna and surrounding features, particularly with respect to thicknesses and separations, may be exaggerated in the sectional figure for clarity. Antenna 21 includes a ceramic or other appropriate high-dielectric, two-sided, substantially planar substrate 47. The upper surface of the substrate 47 has bonded thereto a conductive layer 45, typically a copper layer 45. The opposite lower surface of the substrate similarly has bonded thereto a conductive layer or grounding conductor 44 which may be a copper layer. The conductive layers may be micro-deposited onto the substrate surfaces through a variety of metallization processes or may comprise thin films applied to the substrate surfaces. Immediately adjacent the grounding conductor 44 and electrically coupled thereto is conductive amplifier shield 43 which surrounds and encloses signal conditioning and radio frequency amplification circuitry (not shown). The shield 43 is preferably formed from material compatible with its interface with the grounding conductor. In the present exemplary embodiment, brass is the preferred material for the shield 43. The enclosed circuitry is input coupled to the patch antenna by appropriate means such as a well known pin arrangement coupled at one end to the conductive layer 45 and passed through an aperture in the substrate and grounding conductor to terminate at an opposite end to the circuit input. The ground conductor coupling to the circuit is accomplished in the area of the aperture through which such pin passes. Shielded co-axial cable 49 is coupled to the circuit output for transmission of the amplified signal to a remote processing unit. The shield 43 is preferably soldered or spot welded around the perimeter in contact with the grounding conductor 44.

Grounding strip 61 comprising a thin-film, ductile conductor is coupled to the grounding conductor directly or indirectly through the shield 43. The grounding strip is desirably characterized by low impedance characteristics relative to the characteristic antenna impedance in order that the overall antenna impedance as seen by the signal conditioning and radio frequency amplification circuitry is not significantly altered. Typical patch antenna impedance is substantially 50 ohms and hence most conductive materials will provide suitably low ohmic impedance for the antenna system described herein. Preferably, the grounding conductor is also relatively corrosion resistant and non-reactive so as to not significantly oxidize through exposure to the atmosphere or galvanically react with other contacting metals including the shield 43 and roof panel 11. Silver clad copper is one satisfactory construct for the grounding strip having superior non-reactive and ohmic impedance characteristics; however, a brass construct also performs satisfactorily at lower cost. In the illustrated embodiment, the grounding strip 61 overlays an exposed portion of the grounding conductor 44 and is soldered to the base of the shield 43. A non-conductive case 41 encloses the entire assembly and provides passages for the co-axial cable 49 and grounding strip 61. The case 41 is shown secured to the inner surface of the windshield 18 by an adhesive patch 42.

Figure 5:
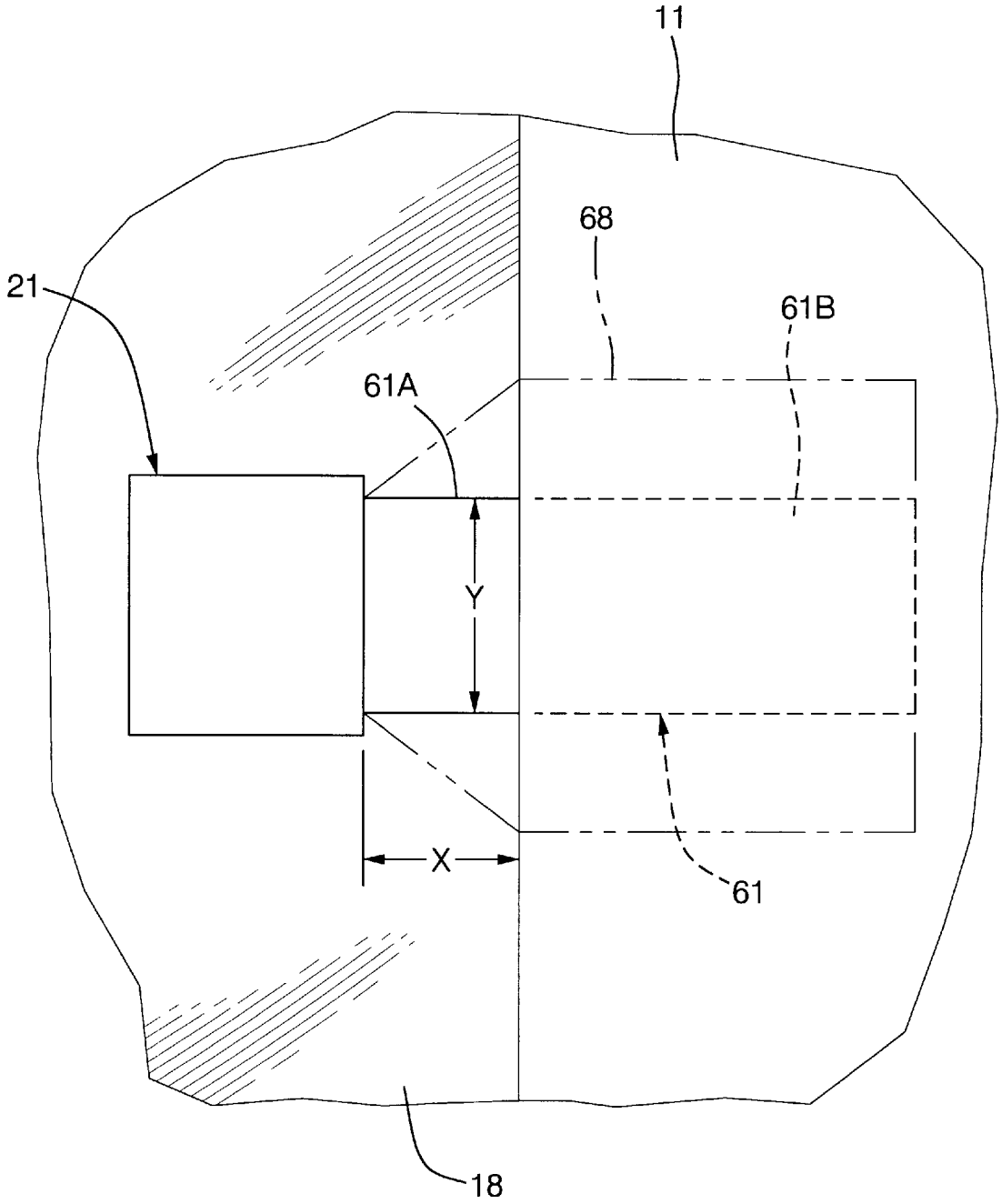

With reference now additionally to FIG. 5, grounding strip 61 extends from the patch antenna 21 to the roof panel 11 of the vehicle 10. The grounding strip 61 includes a portion 61B which is preferably capacitively (AC) coupled to the roof panel 11 to provide low impedance coupling thereto. Alternatively, the grounding strip may be ohmically (DC) coupled to the roof panel such as by spot welding though at the expense of cost and assembly tradeoffs. The grounding strip coupling to the roof panel is desirably characterized by low impedance characteristics relative to the characteristic antenna impedance in order that the overall antenna impedance as seen by the signal conditioning and radio frequency amplification circuitry is not significantly altered. This of course requires knowledge about the specific desired antenna frequency sensitivity in the case of capacitive coupling as will be later described.

The surface of the grounding strip facing the roof panel is coated with a thin adhesive such as is obtainable by spray application. The desirability of thin adhesive is directly related to the effect the separation distance between the grounding strip and roof panel has on the capacitive coupling characteristics and hence grounding strip area required to meet low impedance objectives. Such spray applied adhesives are generally well known and may be controllably applied in thicknesses on the order of magnitude of hundredths of millimeters. An exemplary target capacitive reactance of less than one ohm at the central antenna frequency provides satisfactory performance. This being the case, for an exemplary central frequency of substantially 1.575 Gigahertz—commercial GPS band designated for non-military use—a grounding strip having approximately 6.5 $cm^2$ of surface adhesively bonded to the roof panel provides substantially 300 picofarads of capacitance and a coupling impedance of substantially 0.34 ohms capacitive reactance for a typical adhesive thickness of approximately $5.7\times10^{-2}$ millimeters. Generally, it may be desirable to oversize the grounding strip in the contact area to ensure that sufficient capacitance will be provided in the event that adhesive application process has substantial thickness variance.

Another portion of the grounding strip 61 is designated 61A and generally comprises the portion of the strip from the attachment to the grounding conductor to the first point of low impedance coupling to the roof panel. The grounding strip portion 61A is also desirably characterized by low impedance characteristics relative to the characteristic antenna impedance in order that the overall antenna impedance as seen by the signal conditioning and radio frequency amplification circuitry is not significantly altered. While material choice affects the ohmic impedance to a great degree, the geometry of the portion 61 greatly affects the reactive impedance thereof.

This portion 61A has a separation dimension labeled 'X' which is preferably minimized. The dimension 'X' corresponds substantially to the distance between attachment to the grounding conductor to the first point of low capacitive reactance with the roof panel and effectively provides a transmission line between the patch antenna and the capacitively coupled roof panel. Any conductor, and in this case transmission line length 'X', will have a reactive impedance associated therewith directly related to the length and width of the transmission line and the signal frequency. It is preferred then that the transmission line length 'X' be no larger than one-eighth of the wavelength of the central antenna frequency since larger wavelength fractional distances will result in more than linear increases in the inductive reactance and hence unacceptably high impedance. Additionally, the width of the transmission line 'Y' is desirably also no less than one-eighth of the wavelength of the central antenna frequency for the same reason. Though illustrated rectangularly, the grounding strip 61 may take other shapes such as, for example, having a spreading transmission line region from the patch antenna to the vehicle roof panel as outlined by the phantom line labeled 68. Generally, it is preferable to avoid sharp transitions anywhere along the grounding strip since it is known that such transitions may undesirably cause resonant tuning effects.

In the present exemplary embodiment, a patch antenna as generally described having a grounding strip being capacitively coupled to a vehicle roof panel via low impedance interface would preferably have a transmission line portion 61A no greater than one-eighth of the central frequency wavelength. In the case of a 1.575 Gigahertz central frequency—corresponding to a 0.19 m wavelength—a separation of substantially no more than 2.4 cm or approximately one inch is advisable.

The present invention is relatively easy to install either in the assembly plant or in the field as an aftermarket addition. A preferred antenna comprises a double-faced adhesive pad 42 adhered on one side to the upper surface of the non-conductive case 41 and a protective peel-back paper on the other side. Also, the grounding strip 61 of a preferred antenna has a pre-applied adhesive 69 on the side thereof intended for adhesion to the roof panel. The adhesive layer 69 on the grounding strip is similarly protected by a protective peel-back paper. The assembler will preferably remove the protective paper from the double-faced adhesive pad 42 and firmly press the assembly against the vehicle windshield or backlight at an appropriate location on the inner surface of the glass which allows for the first point of contact of the grounding strip to vehicle roof to be as small as practical and preferably no more than one-eighth of a wavelength of the central frequency. The assembler next removes the protective paper from the adhesive backed grounding strip to expose the adhesive. The grounding strip is then applied to the roof panel from the points closest the antenna outward toward the end of the grounding strip. The grounding strip may then be smoothed for conformance to the roof using the hand, an appropriately sized roller or other means. Assembly in the assembly plant may be performed prior to installation of certain interior trim components such as the vehicle headliner and reveal moldings, while aftermarket assembly may require full or partial removal of such trim components to gain access and clearance during installation.

The previously described embodiment has been disclosed with respect to a certain GPS band frequency. It is to be understood that the antenna system disclosed herein may be adapted for other frequencies and vehicular communication systems, such as cellular communication systems.

The present invention has been described with respect to preferred features and embodiment. Certain alternative features and embodiments may be apparent to those having ordinary skill in the art. The features and embodiments disclosed herein are understood to be offered by way of non-limiting examples and practical implementations of the invention which scope is limited only by the claims as appended hereto.

I claim:

1. An antenna system for a motor vehicle having a substantially horizontal roof panel formed from an electrically conductive material and a glass panel raked down and away from the roof panel, comprising:

a patch antenna including a grounding conductor and having a characteristic antenna impedance, said antenna being fixed to an inner surface of the glass panel adjacent to the roof panel; and, a low impedance coupling, relative to the antenna impedance, between the grounding conductor and roof panel wherein the low impedance coupling comprises a conductive strip.

2. An antenna system for a vehicle as claimed in claim 1 wherein the conductive strip is capacitively coupled to the roof panel.

3. An antenna system for a vehicle as claimed in claim 1 wherein the conductive strip includes a portion between the grounding conductor and the closest point of low impedance coupling to the roof panel, said portion having length no greater than substantially one-eighth of the wavelength of a desired signal frequency.

4. An antenna system for a vehicle as claimed in claim 1 wherein the conductive strip includes a portion between the grounding conductor and the closest point of low impedance coupling to the roof panel, said portion having width no less than substantially one-eighth of the wavelength of a desired signal frequency.

5. An antenna system for a motor vehicle as claimed in claim 3 wherein the portion of the conductive strip between the grounding conductor and the closest point of low impedance coupling with the roof panel has width no less than substantially one-eighth of the wavelength of the desired signal frequency.

6. An antenna system for a motor vehicle as claimed in claim 2 further comprising an adhesive layer between the conductive strip and the roof panel in an area of capacitive coupling.

7. An antenna system for a motor vehicle having a substantially horizontal roof panel formed from an electrically conductive material and a glass panel raked down and away from the roof panel, comprising:

a patch antenna including a grounding conductor and having a characteristic antenna impedance, said antenna being fixed to an inner surface of the glass panel adjacent to the roof panel;

a conductive strip having width no less than substantially one-eighth of the wavelength of a desired signal frequency, said conductive strip being ohmically coupled to the grounding conductor and extending beneath the roof panel; and, an adhesive disposed between the roof panel and conductive strip for adhering the conductive strip to the roof panel to establish a region of low impedance capacitive coupling, relative to the antenna impedance, between the conductive strip and roof panel.

8. An antenna system as claimed in claim 7 wherein the conductive strip includes a portion between the ohmic coupling to the grounding conductor and the region of low impedance capacitive coupling, said portion having length no greater than substantially one-eighth of the wavelength of the desired signal frequency.

9. A method for modifying the maximum gain vector of a patch antenna including a grounding conductor to provide an improved gain pattern in the general direction over a conductive roof panel of a vehicle, the antenna having a characteristic antenna impedance and adapted for mounting to a glass panel on the vehicle which is raked down and away from the roof panel, the method comprising the steps:

mounting the patch antenna to an interior surface of the glass panel substantially adjacent to the roof panel; and, providing a low impedance coupling, relative to the antenna impedance, of the grounding conductor to the roof panel wherein the step of providing a low impedance coupling comprises the steps:

providing a conductive strip;

coupling the conductive strip to the grounding conductor; and, coupling the conductive strip to the roof panel.

10. A method for modifying the maximum gain vector of a patch antenna as claimed in claim 9 wherein the low impedance coupling is substantially capacitive and the step of coupling the conductive strip to the roof panel comprises the steps:

providing an adhesive on a side of the strip facing the roof panel; and, applying the strip to the roof panel such that the adhesive adheres the strip to the roof panel.

* * * * *